US008365341B2

(12) United States Patent
Lin

(10) Patent No.: US 8,365,341 B2
(45) Date of Patent: Feb. 5, 2013

(54) MOP ASSEMBLY

(75) Inventor: Chang-I Lin, Taoyuan Hsien (TW)

(73) Assignee: Dikai International Enterprise Co., Ltd., Taoyuan Hsien (TW)

( * ) Notice: Subject to any disclaimer, the term of this patent is extended or adjusted under 35 U.S.C. 154(b) by 223 days.

(21) Appl. No.: 12/980,896

(22) Filed: Dec. 29, 2010

(65) Prior Publication Data

US 2012/0090122 A1 Apr. 19, 2012

(30) Foreign Application Priority Data

Oct. 18, 2010 (TW) ..... 99220039 U
Oct. 18, 2010 (TW) ..... 99220040 U

(51) Int. Cl.
*A47L 13/20* (2006.01)
*A47L 13/58* (2006.01)

(52) U.S. Cl. ..... 15/229.6; 15/228

(58) Field of Classification Search ..... 15/228, 15/229.6; *A47L 13/20, 13/58*
See application file for complete search history.

(56) References Cited

U.S. PATENT DOCUMENTS 8,220,101 B2 * 7/2012 Chen ..... 15/119.1

* cited by examiner

*Primary Examiner* — Monica Carter
*Assistant Examiner* — Stephanie N Berry
(74) *Attorney, Agent, or Firm* — Rosenberg, Klein & Lee

(57) ABSTRACT

A mop assembly includes a handgrip structure disposed above, connected telescopically to a rotary rod structure from above and a cleaning mop connected pivotally to a bottom end of the rotary rod structure. Once the cleaning mop is placed within a draining bucket, axially downward and upward movement of the handgrip structure relative to the rotary rod structure results in axial rotation of the rotary rod structure and the draining bucket relative to the handgrip structure in a predetermined direction and hence draining the water out from the cleaning mop.

8 Claims, 13 Drawing Sheets

MOP ASSEMBLY

This application claims the benefits of the Taiwan Patent Application Serial Nos. 099220039 and 099220040 filed on Oct. 18, 2010, the subject matters of which are incorporated herein by reference.

BACKGROUND OF THE INVENTION

1. Field of the Invention

The present invention relates to a mop assembly, more particularly to one including a handgrip structure movable axially relative to a rotary rod structure so as to spin a cleaning mop attached to the rotary rod structure, thereby draining the water out from the cleaning mop.

2. Description of the Prior Art

A mop assembly is usually used for cleaning our environment or floor. A conventional mop assembly generally includes a cleaning mop attached to a bottom end of a handgrip rod. The cleaning mop is firstly wetted for cleaning the floor. After each cleaning operation, the dirty cleaning mop is immersed within a water bucket and the water from the wiping cloth is squeezed out from the cleaning mop manually. It is rather unhygienic and laborious to drain the water out the cleaning mop manually. Presently, several types of mop assemblies with different draining systems have been developed in order to economize human labor and to effectively quickly cleaning the floors.

The first type mop assembly includes a draining bucket installed within a water bucket in such a manner that after the soaked cleaning mop is placed within the draining bucket, the user must apply a considerable force to push the cleaning mop against the draining bucket in order drain the water out from the cleaning mop. Only then, the wiping cloth may get dry.

The second type mop assembly includes a squeezing device installed in the water bucket such that after the wiping cloth of the cleaning mop are placed in the squeezing device, the user must use his foot to press a squeezing pedal in order to drain the water out from the wiping cloth. After the pedaling operation, the user must lift the handgrip rod upward in order to remove the wiping cloth from the squeezing device. It involves rather complicated steps to drain the water out from the wiping cloth. In the event, the user encounters loss of stability during the pedaling operation, he may be jeopardized.

The third type mop assembly includes a draining bucket installed within a water bucket for receiving the cleaning mop. The draining bucket spins continuously when the user foot pedals a pedaling device such that the water is drain out from the wiping cloth by virtue of the centrifugal force. It economizes human labor and working time but the water bucket structure is complicated and thus results in high manufacturing expense for the manufacturers. In addition, there is the problem of loss of stability for the user.

SUMMARY OF THE INVENTION

In order to overcome the aforementioned disadvantages, the main object of the present invention is to provide a rotary type mop assembly, which permits the user to place a cleaning mop within a draining bucket after which the user can move a handgrip structure axially upward and downward relative to a rotary rod structure telescopically connected to the handgrip structure so as to drain the water out from the cleaning mop.

The mop assembly of the present invention accordingly includes a rotary mop member and a spinning structure. The rotary mop member includes a rotary rod structure having a rotary rod defining an elongated axial space therein, and a driving unit fixed securely within the axial space of the rotary rod and formed with a central spiral hole, and a handgrip structure disposed above the rotary structure and includes a handgrip rod connected telescopically to the rotary rod from above, a spiral spindle disposed within the handgrip rod. The spiral spindle has an upper portion fixed to the handgrip rod so as to move together therewith and a lower portion engaging rotatably to the spiral hole within the driving unit and extending into the rotary rod.

A cleaning mop is connected pivotally to a bottom end of the rotary rod, and includes a circular fixing member, a circular holding plate connected detachably to a lower part of the fixing member and holding several pieces of wiping cloth for cleaning the floor.

The spinning structure includes a water bucket, a draining bucket disposed within the water bucket for receiving the cleaning mop therein, and a support post installed vertically in the water bucket below the draining bucket in such a manner that the support post has an upper end supporting the draining bucket thereabove.

When it is desired to drain the cleaning mop, the latter is placed within the draining bucket, axially downward movement of the handgrip structure relative to the rotary rod structure results in axial rotation of the spiral spindle within the spiral hole in the driving unit into a predetermined direction, thereby driving the draining bucket to rotate in the predetermined direction and hence draining the water out from the cleaning mop by virtue of centrifugal force and wherein axially upward movement of the handgrip structure relative to the rotary rod structure results in continuously driving and rotating the draining bucket in the predetermined direction.

As mentioned in the above paragraphs, the mop assembly of the present invention includes a simple structure, therefore the manufacturing cost can be cut down. In the conventional mop assembly, whenever it is desired to drain the water out from the wiping cloth, the user has to manually squeeze the water out from the wiping cloth or by pedaling the pressing device by foot. There is also the danger for the user to fall accidentally onto the floor due to loss of stability during the pedaling operation. However, when it is desired to clean the cleaning mop of the mop assembly of the present invention, the user needs to place the cleaning mop within the draining bucket first and he only needs to move the handgrip structure axially upward and downward relative to the rotary rod structure, thereby spinning the draining bucket in the predetermined direction, hence draining the water out from the cleaning mop.

In addition, the user can easily replace the dirty wiping cloth in the holding plate with a new ones once the former is utterly dirty, thereby economizing a plenty of maintenance fee.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
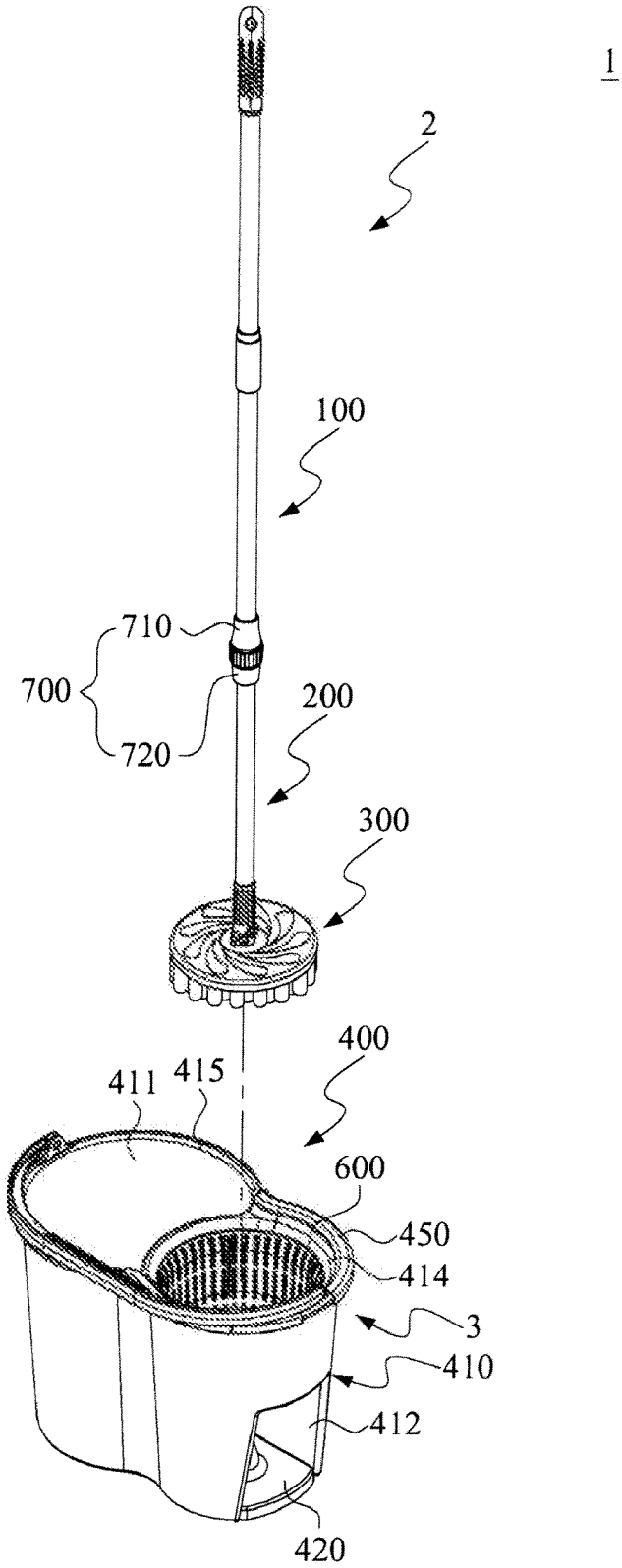
FIG. 1 shows a perspective view of a mop assembly of the present invention.

FIG. 1 shows a perspective view of a mop assembly 1 of the present invention, includes a rotary mop member 2 and a spinning structure 3. The rotary mop member 2 includes a handgrip structure 100, a rotary rod structure 200, a cleaning mop 300 and a fastening mechanism 700. The handgrip structure 100 is disposed above and connected telescopically to the rotary rod structure 200. The cleaning mop 300 is pivotally connected to a bottom part of the rotary rod structure 200.

The fastening mechanism 700 is sleeved around the handgrip structure 100 and the rotary rod structure 200 for fastening the two in such a manner to prevent axial movement and axial rotation relative to each other when rotary mop member 2 is used for cleaning the floor. A sweeper can either hold the handgrip structure 100 or the rotary rod structure 200 in order to move the cleaning mop 300 over the floor, hence sweeping and cleaning the floor. Since the cleaning mop 300 is connected pivotally to the rotary rod structure 200, the cleaning mop 300 can abut against the floor while the handgrip structure 100 or the rotary rod structure 200 is held in an inclination angle relative to the cleaning mop 300.

The spinning structure 3 includes a water bucket 400 and a draining bucket 600. When it is desired to drain the water out from the cleaning mop 300, the cleaning mop 300 is placed firstly within the draining bucket 600 and axially and reciprocally downward and upward movements of the handgrip structure 100 relative to the rotary rod structure 200 results in driving the draining bucket 600 to spin or rotate quickly in a predetermined direction and hence draining the water out from the cleaning mop 300, thereby economizing human labor and providing convenience to the user.

Figure 2:
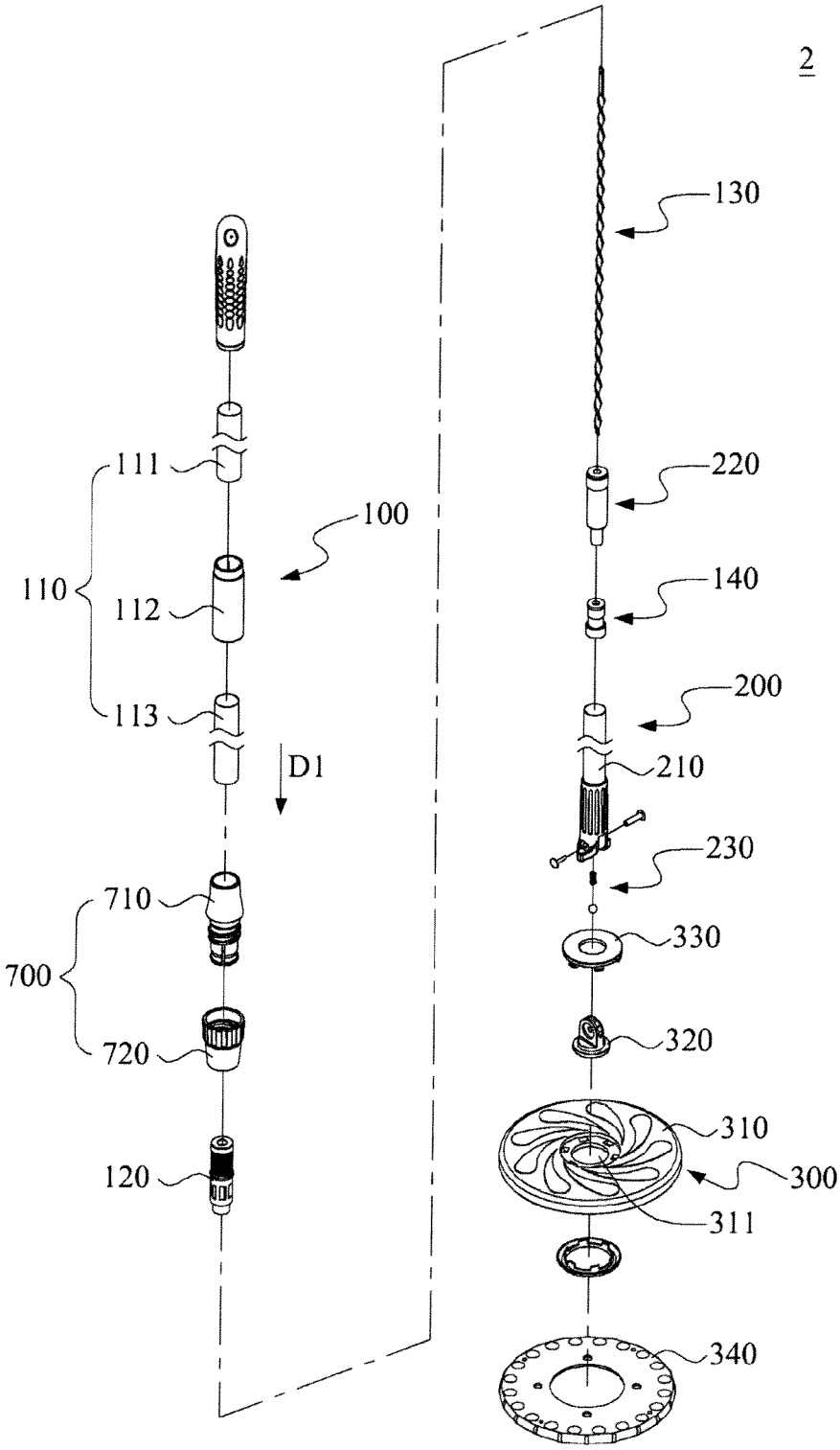
FIG. 2 is a partly exploded view of the first embodiment of the mop assembly of the present invention.
Figure 3:
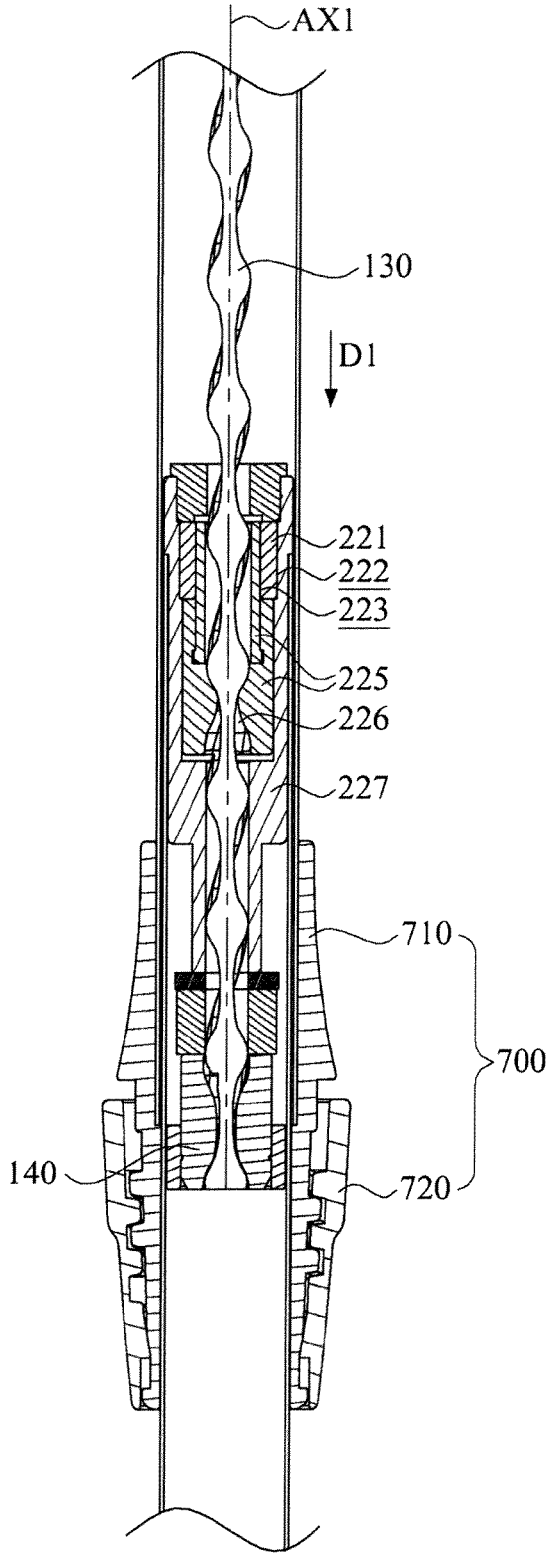
FIG. 3 is a fragmentary sectional view of the first embodiment of the mop assembly of the present invention.

Referring to FIGS. 2 and 3, wherein FIG. 2 shows a partly exploded view of the first embodiment of the mop assembly of the present invention while FIG. 3 shows is a fragmentary sectional view of the first embodiment of the mop assembly of the present invention. The handgrip structure 100 extends along the vertical direction, includes a handgrip rod 110, a spiral spindle 130 and a rod protection element 140. In this embodiment, the handgrip rod 110 consists of an upper rod section 111, a lower rod section 113 and a rod connector 112 disposed between and interconnecting detachably the upper and lower rod sections 111, 113. Thus, when it is desired, the upper, lower rod sections 111, 113 and the rod connector 112 can be detached relative to one another in order to minimize the storing space thereof.

The spiral spindle 130 is made from metal, and has spiral groove on its outer peripheral surface. The spiral spindle 130 is disposed within the handgrip rod 110, and has an upper portion fixed to a top end of the handgrip rod 110 via a fastening sleeve 120 (see FIG. 6) so as to move axially together therewith and a lower portion provided with the rod protection element 140, which prevents the spiral spindle 130 contacting an inner wall of the handgrip rod 110 during axial movement of the same relative to the rotary rod structure 200. The rod protection 140 is made from rubber materials.

The rotary rod structure 200 includes a rotary rod 210, in form of a hollow tube, extends along the vertical direction and defines an elongated axial space therein. The cleaning mop 300 is connected pivotally a bottom end of the rotary rod 210. The handgrip rod 110 is telescopically connected to the rotary rod 210 from above.

The rotary rod structure 200 further includes a driving unit 220 fixed securely within the axial space of the rotary rod 210 and formed with a central spiral hole 226 to permit extension engageably and rotatably of the lower portion of the spiral spindle 130 such that the lower portion thereof extends into the rotary rod 210. As best shown in FIG. 3, driving unit 220 further includes a unidirectional rotation unit 221 and a direction guider 225.

The unidirectional rotation unit 221, in the form of a hollow tube, has an outer wall 222 fixed to the inner surface of the d rotary rod 210. Alternately, the outer wall 222 of the unidirectional rotation unit 221 can also be fixed to the top end of the rotary rod 210. The unidirectional rotation unit 221 is a unidirectional bearing unit rotatable in a single direction about an axis AX1. Since the structure of the unidirectional bearing unit is well known in the art, a detailed description thereof is omitted herein for the sake of brevity.

The direction guider 225, in the form of a hollow tube, is disposed within and rotatable relative to an inner wall 223 of the unidirectional rotation unit 221 in the single direction, and defines the spiral hole 226 therethrough. Under this condition, axially downward movement of the spiral spindle 130 (together with the handgrip rod 110) results in driving the direction guider 225 to rotate in the predetermined direction and hence rotating the unidirectional rotation unit 221 and the rotary rod 210 in the predetermined direction.

In this embodiment, the driving unit 220 further includes a fixing element 227, which fastens the unidirectional rotation unit 221 securely to the inner surface of the rotary rod 210. In another embodiment, the unidirectional rotation unit 221 can be integrally formed with the rotary rod 210.

The fastening mechanism 700 preferably includes a fastener sleeve 720 and a fastening element 710, both of which are in the form hollow tubes. The fastening element 710 is fixed on an outer surface of the handgrip rod 110, and is sleeved pivotally onto the rotary rod 210. The fastener sleeve 720 is fastened threadedly on the fastening element 710. Under this condition, once the fastener sleeve 720 is threaded securely relative to the fastening element 710, the handgrip rod 110 and the rotary rod 210 are mobilized, thereby preventing axial movement and axial rotation relative to each other.

Figure 4:
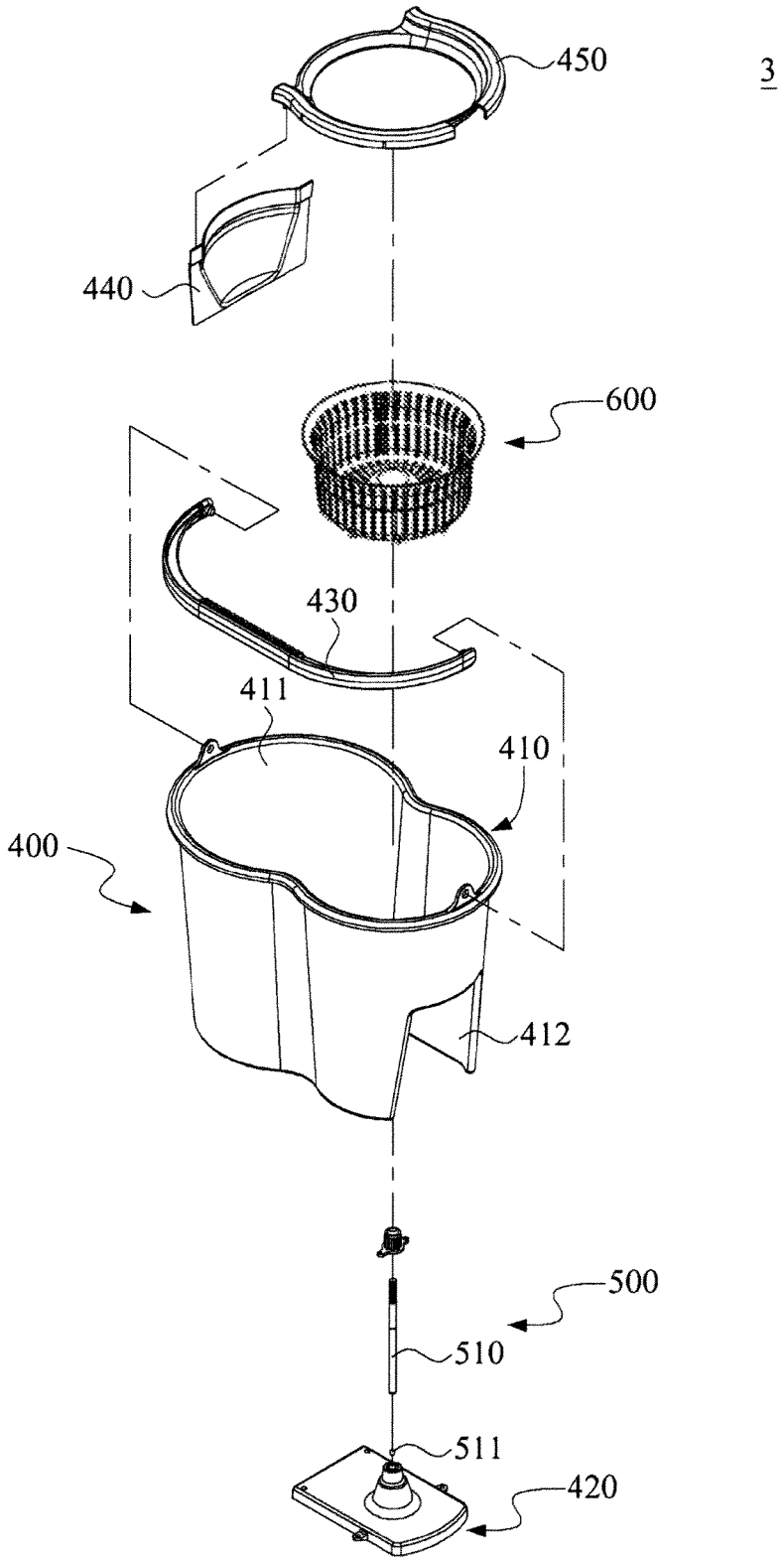
FIG. 4 is a perspective and exploded view of a spinning structure employed in the first embodiment of the mop assembly of the present invention.
Figure 5:
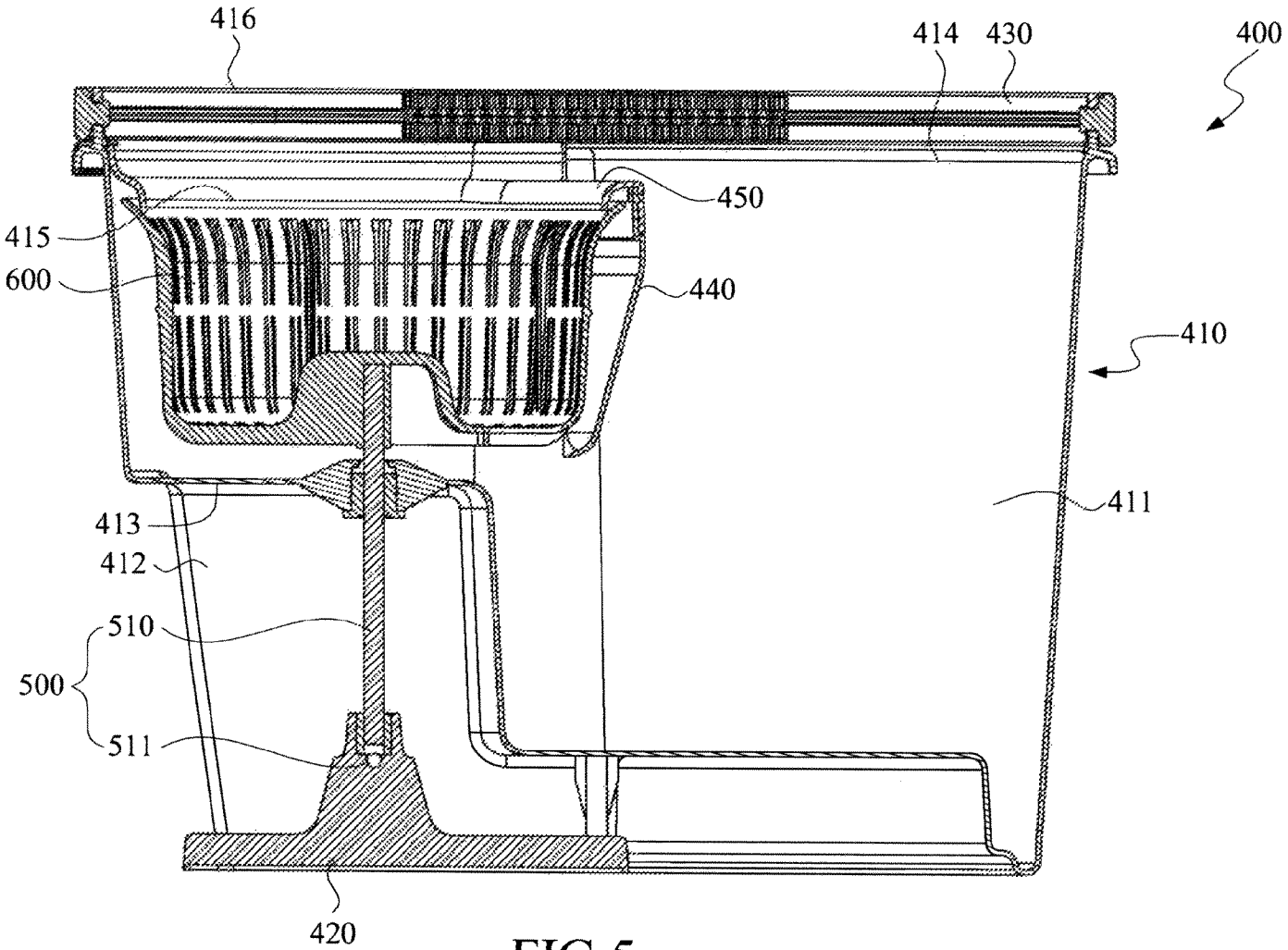
FIG. 5 is a cross-sectional view of the spinning structure employed in the first embodiment of the mop assembly of the present invention.

Referring to FIGS. 4 and 5, wherein FIG. 4 is a perspective and exploded view of the spinning structure employed 3 in the first embodiment of the mop assembly of the present invention while FIG. 5 is a cross-sectional view of the spinning structure 3. The spinning structure 3 includes a water bucket 400, a draining bucket 600 and a support post mechanism 500. The water bucket 400 includes a bucket body 410, a support base 420 and a bucket handle 430, a spill-protection plate 440 and a protection ring 450. The bucket body 410 defines a water compartment 411 for receiving the water therein and a reception room 412, includes a partition plate 413 disposed between so as to isolate the water compartment 411 relative to the reception room 412. The handle 430 is attached pivotally to an upper end of the bucket body 410 to facilitate carrying of the water bucket 400. The support base 420 is disposed securely within the reception room 412 for receiving rotatably a lower end of the support post 150 while an upper end thereof extends through the partition plate 413 into the water compartment 411 for attaching securely to the draining bucket 600.

The protection ring 450 is sleeved around the top edge of the bucket body 410. The bucket body 410 is further formed with a cleaning access 414 and a circular spinning access 416 for access to the draining bucket 600 adjacent to the protection ring 450 (see FIG. 1). As illustrated, the draining bucket 600 is located at a level below the protection ring 450 adjacent to the cleaning access 414. The spinning access 416 has a diameter smaller than the diameter 415 of the draining bucket 600 in order to prevent accidentally removal of the draining bucket 600 from the bucket body 410 during the swift spinning operation of the draining bucket 600.

The draining bucket 600 is disposed within the bucket body 410 for receiving the cleaning mop 300 therein. A spill-protection plate 440 is disposed vertically within the water compartment 411 proximate to the draining bucket 600 for preventing water from the cleaning mop 300 spilling from the bucket body 410 to an exterior of the bucket body 410 via the spinning access 416 during the spinning operation of the draining bucket 600 in the predetermined direction. In addition, due to vertically present of the spill-protection plate 440 in the water compartment 411 and since a gap is formed between the spill-protection plate 440 and the partition plate 413, the drained out water from the cleaning mop 300 flows into the water compartment 411 via the gap during the spinning operation of the draining bucket 600 in the predetermined direction.

The support post mechanism 500 may further includes a support bearing 511 disposed between the support post 510 and the support base 420 to reduce friction therebetween during the spinning operation of the draining bucket 600.

In another embodiment, the support base 420 of the post mechanism 500 can be directly installed on the bottom surface of the water compartment 411 while the lower end of the support post 510 can be rotatably mounted on the support base 420, thereby economizing the expense of forming of the reception room 412.

Figure 6:
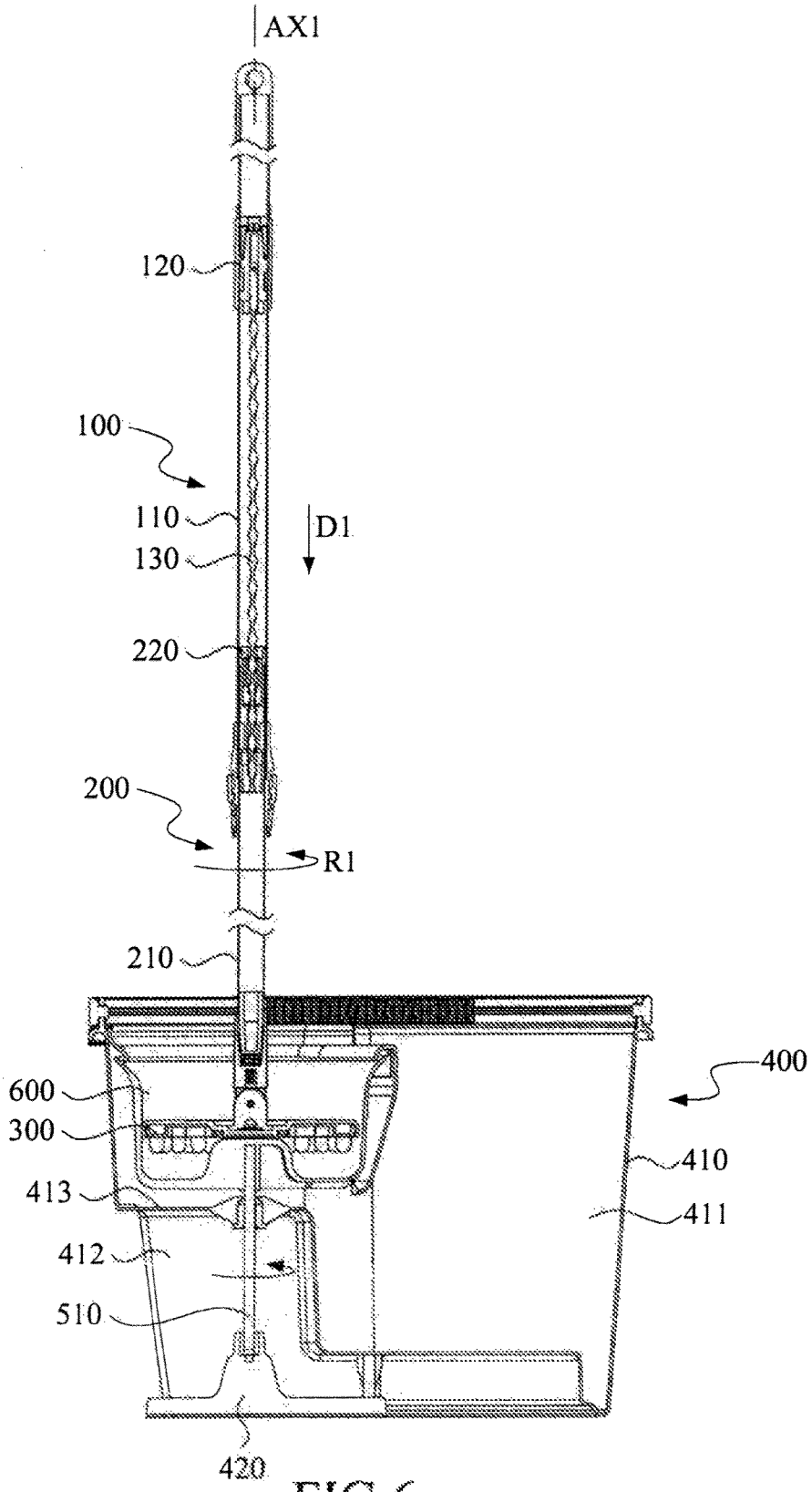
FIGS. 6 and 7 respectively show the spinning structure of the first embodiment of the mop assembly of the present invention in operation.
Figure 7:
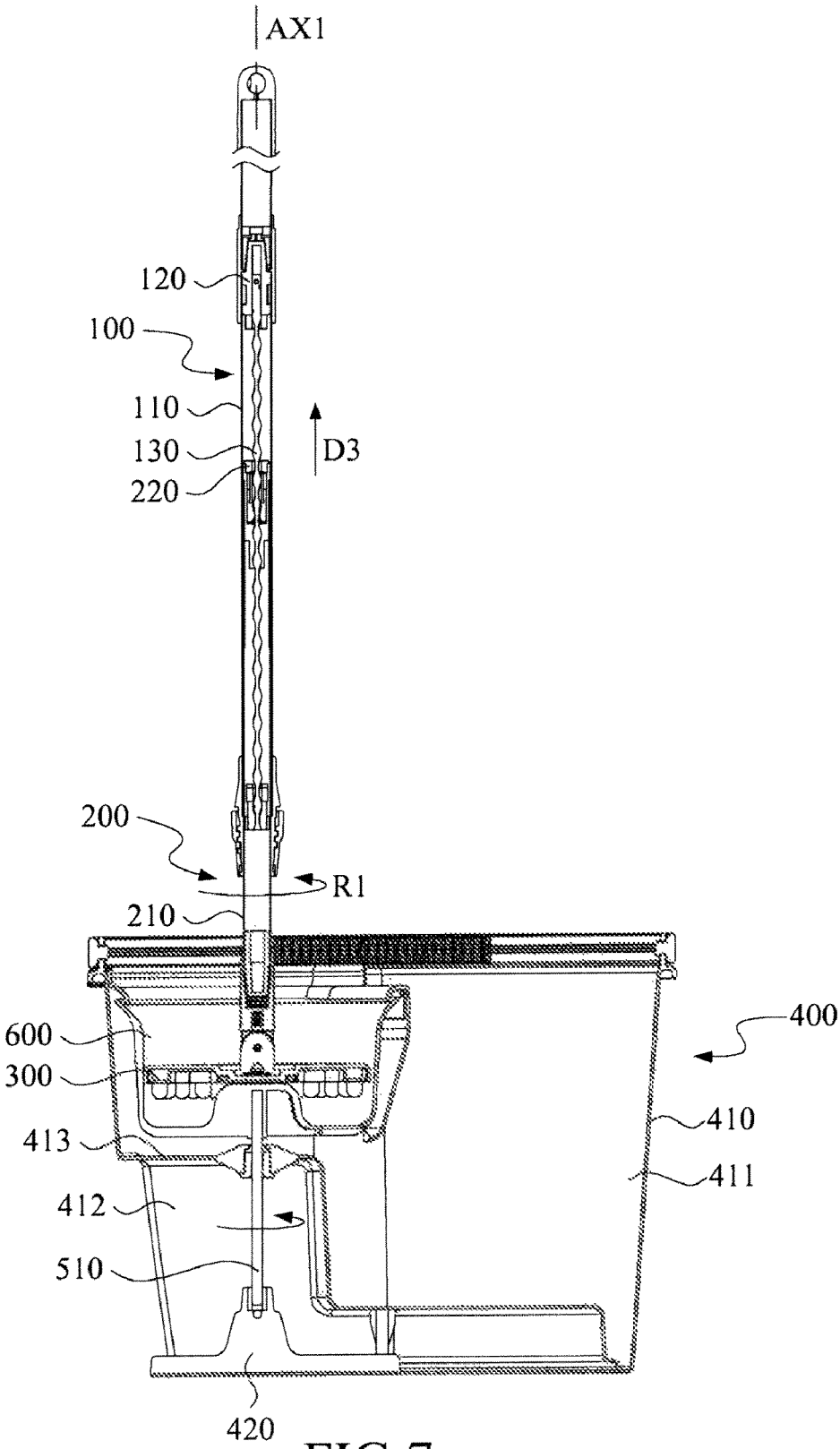

FIGS. 6 and 7 respectively show the first embodiment of the mop assembly 1 of the present invention in operation.

As illustrated in FIGS. 1 and 6, when it is desired to drain the water out from the cleaning mop 300, the latter is first of all placed within the draining bucket 600. The user can axially pull the handgrip structure 100 upward along the upward vertical direction and then push the handgrip structure 100 downward relative to the rotary rod structure 200 along the downward vertical direction D1. This movement results in axial rotation of the spiral spindle 130 about the central axis AX1 within the spiral hole 226 in the direction guider 225 into a predetermined direction R1, thereby driving the unidirectional rotation unit 221 in the predetermined direction R1. Since the unidirectional rotation unit 221 is a unidirectional rotation bearing unit rotatable in the single direction (i.e., the predetermined direction) and since the unidirectional rotation unit 221 is fixed to the rotary rod 210, the later rotates about the center axis AX1 in the predetermined direction R1.

Thus, once the cleaning mop 300 is placed within the draining bucket 600, and axially downward movement of the handgrip structure 100 relative to the rotary rod structure 200 along the downward vertical direction D1 results in axial rotation of the spiral spindle 130 within the spiral hole 226 in the driving unit 220 into the predetermined direction R1, thereby driving the assembly of the rotary rod structure 200, the cleaning mop 300 and the draining bucket 600 to rotate in the predetermined direction R1 and hence draining the water out from the cleaning mop by virtue of centrifugal force.

Referring to FIG. 7, in the same manner axially upward movement of the handgrip structure 100 relative to the rotary rod structure 200 along the upward vertical direction D3 causes axial rotation of the spiral spindle 130 within the spiral hole 226 in the direction guider 225, which, in turn, results in reverse rotation of the direction guider driving unit 225 opposite to the predetermined direction R1. Note that the direction of D1 and D3 are opposite to each other. As best shown in FIG. 3, since the unidirectional rotation unit 221 is a unidirectional rotation bearing unit rotatable in the single and is unable to drive the rotary rod 210 in rotate in the reverse direction, thereby continuously driving the assembly of the rotary rod structure 200, the cleaning mop 300 and the draining bucket 600 to rotate in the predetermined direction R1.

In is obvious from abovementioned paragraphs, the user can easily and reciprocally axially moves the handgrip rod 110 upward and downward relative to the rotary rod 210 for rotating the cleaning mop 300 without actually operating the spinning structure 3 in order to drain the water out from the cleaning mop 300.

Figure 8:
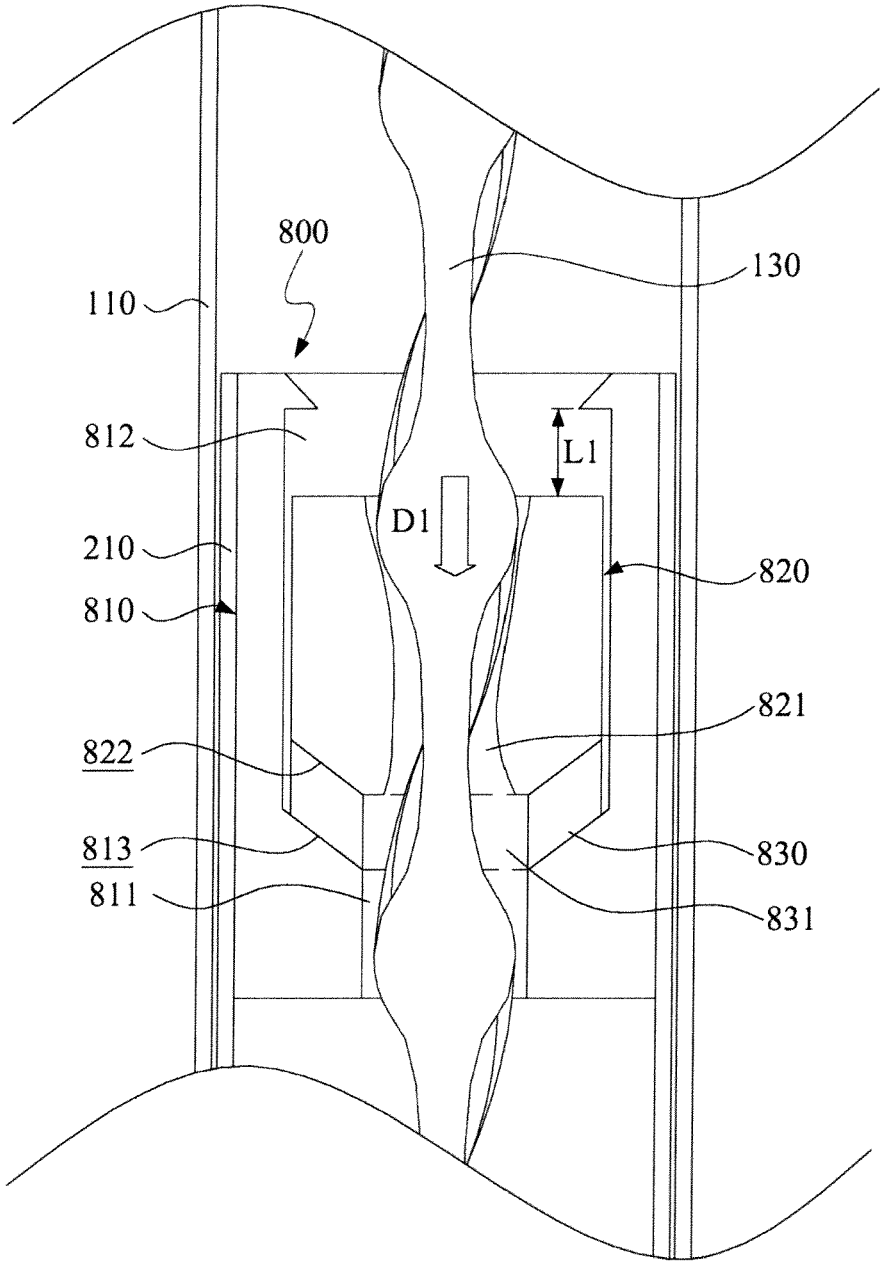
FIGS. 8 and 9 respectively show fragmentary sectional view of the second embodiment of the mop assembly of the present invention in operation.

FIG. 8 shows a fragmentary sectional view of the second embodiment of the mop assembly of the present invention in operation. The second embodiment has the structure similar to the previous embodiment. The only difference resides in the driving unit 800.

The driving unit 800 accordingly includes a limiting unit 810, a direction guider 820 and a friction-producing element 830. The limiting unit 810 is a tube-shaped structure, has an outer wall fixed to an inner surface of the rotary rod 210, an inner wall defining a limiting chamber 812, which is formed a lower friction face 813 and a bottom through hole 811 formed through the lower friction face 813. The limiting chamber 812 is in spatial communication with the through hole 811 along the AX1 axis. The direction guider 820 is a tube-shaped structure, is disposed within the limiting chamber 812, defines the spiral hole 821, and has an upper friction face 822.

The friction-producing element 830 is disposed within the limiting chamber 812 between the direction guider 820 and the lower friction face 813 of the limiting unit 810. The friction-producing element 830 defines a rotation through hole 831. The friction-producing element 830 is made preferably from rubber material such that when it abuts forcefully against the limiting unit 810 and the direction guider 820, a friction force is generated thereamong.

In this embodiment, The friction-producing element 830 is a truncated cone-shaped structure, has a top friction face 832 disposed adjacent to the upper friction face 822 of the direction guider 820 and a bottom friction face 833 disposed adjacent to the lower friction face 813 of the limiting unit 810. In addition, the spiral spindle extends through the through hole 811 in the limiting unit 810, rotatably engaging the spiral hole 821 in the direction guider 820, and the rotation through hole 831 in the friction-producing element 830, as best shown in FIG. 8, in such a manner that, axially downward movement of the handgrip structure 100 relative to the rotary rod structure 200 along the downward vertical direct D1 results in the axial rotation of the spiral spindle 130 within the spiral hole 821, thereby rotating the direction guider 820 in the predetermined direction R1 and simultaneously and axially moving the direction guider 820 downward so as to abut the top and bottom friction faces 832, 833 of the friction-producing element 830 respectively against the upper and lower friction faces 813, 822 of the limiting unit 810 and the direction guider 820, hence generating friction force to rotate the limiting unit 810 in the predetermined direction R1, thereby driving the assembly of the rotary rod structure 200, the cleaning mop 300 and the draining bucket 600 to rotate in the predetermined direction R1, hence draining the water out from the cleaning mop 300.

Figure 9:
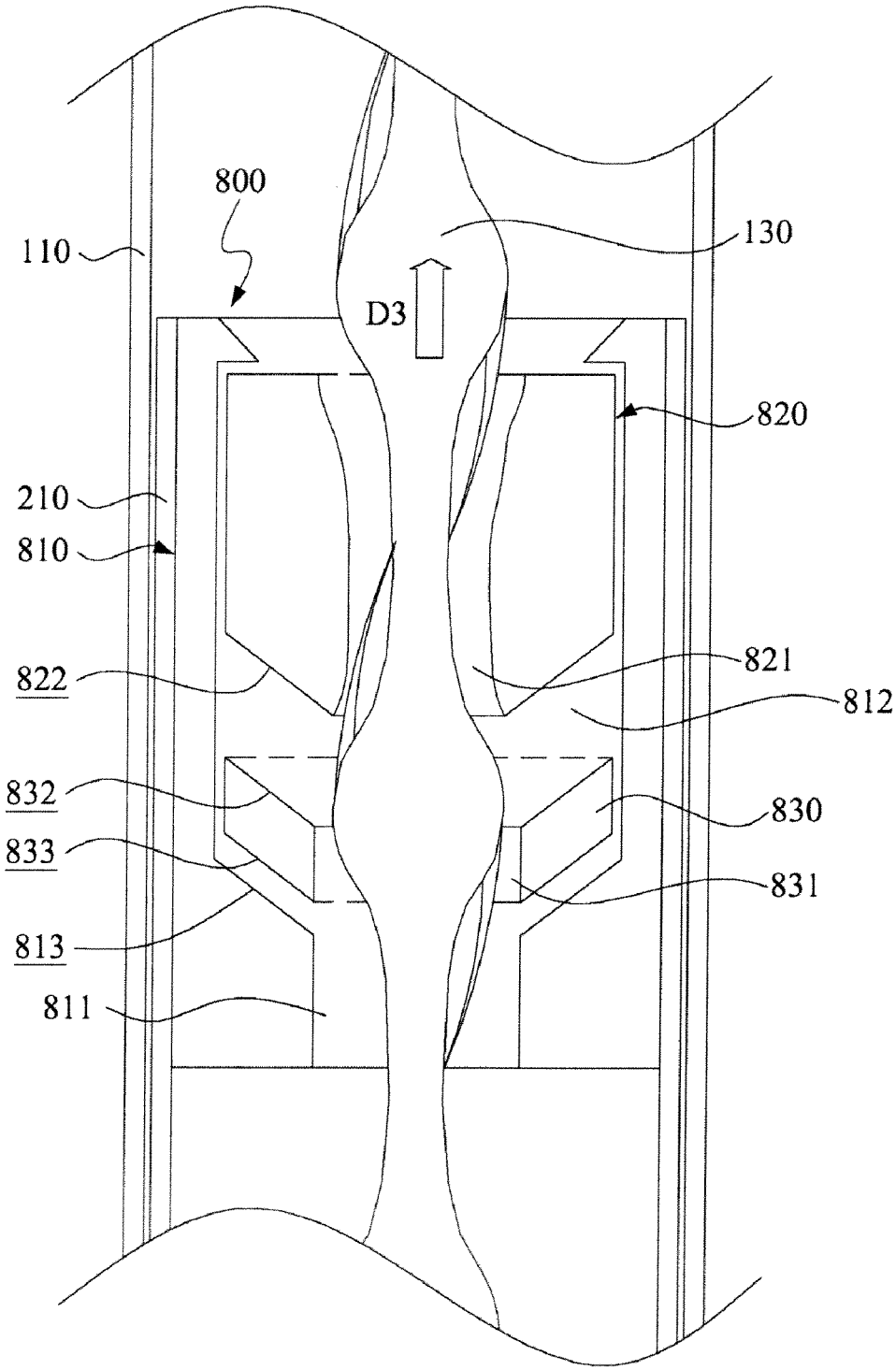

In the same manner and as best illustrated in FIG. 9, axially upward movement of the handgrip structure 100 relative to the rotary rod structure 200 along the upward vertical direction D3 results in axial rotation of the spiral spindle 130 within the spiral hole 821. Due to presence of stop member at the top end of the limiting chamber 812, rotation the spiral spindle 130 in the predetermined direction R1 results in and simultaneously and axially moving the direction guider 820 upward away from the friction-producing element 830. Note that during axial upward movement of the spiral spindle 130, though the direction guider 820 rotates in the reverse direction opposite to the predetermined direction R1, the friction-producing element 830 and the limiting unit 810 are not rotated in the reverse direction, i.e., driving the assembly of the rotary rod structure 200, the cleaning mop 300 and the draining bucket 600 to rotate in the predetermined direction R1.

Figure 10:
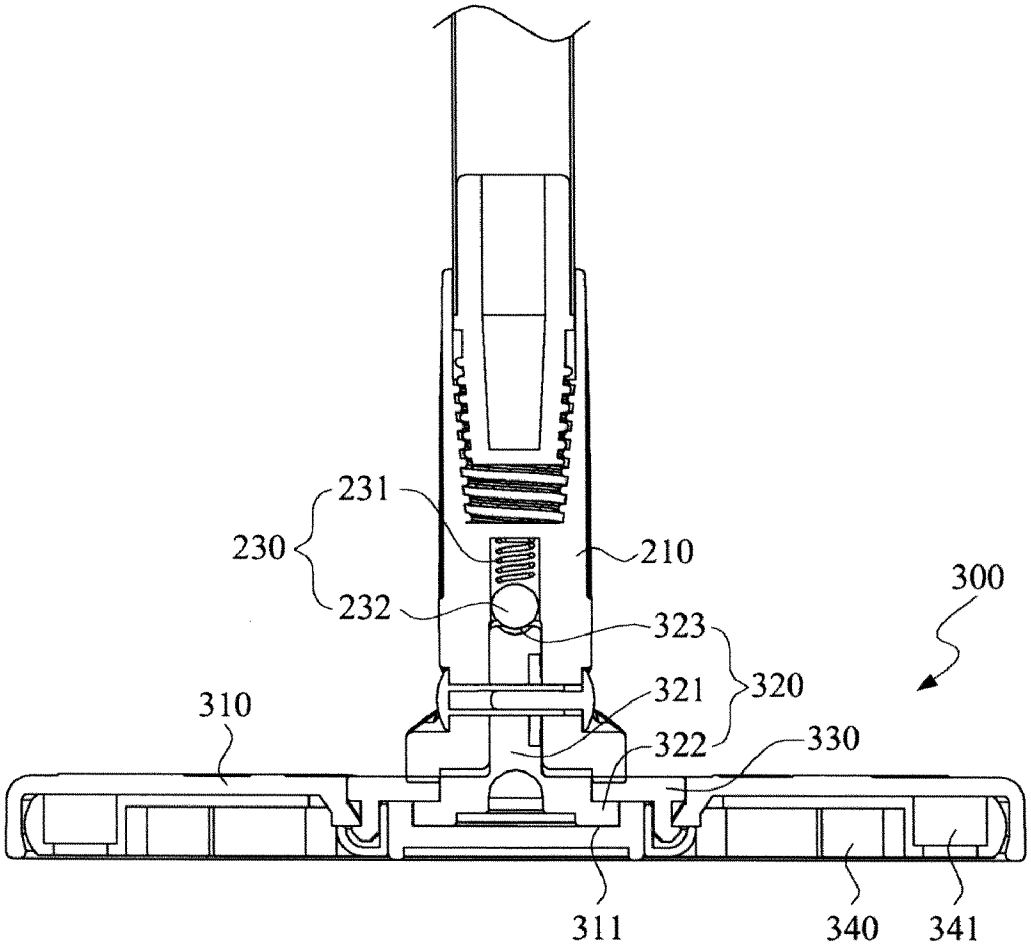
FIG. 10 shows cross-sectional view of a cleaning mop employed in the mop assembly of the present invention.

Referring to FIGS. 2 and 10, wherein FIG. 10 shows a cross-sectional view of the rotary mop member 2 employed in the mop assembly of the present invention. As illustrated, the cleaning mop 300 is connected pivotally to the bottom end of the rotary rod 210. The cleaning mop 300 includes a circular fixing member 310, a pivot element 320, a circular limiting cover 330, a circular holding plate 340 and plurality pieces of wiping cloth 350 (see FIG. 13).

The fixing member 310 is circular in shape, has an upper surface formed with a circular pivot hole 311 at center portion thereof. The pivot element 320 includes a circular pivot seat 322 seated in the circular pivot hole 311 of the fixing member 310, and has a pivot post 321 extending from the pivot seat 322 and formed with a plurality of positioning recesses 323 at the top portion thereof.

The limiting cover 330 covers the circular pivot hole 311 in the fixing member 310, permits extension of the pivot post 321 therethrough for connecting pivotally to the bottom end of the rotary rod 210 in such a manner that the limiting cover 330 and the pivot seat 322 are rotatable together relative the circular hole 311 in the fixing member 310.

Figure 11:
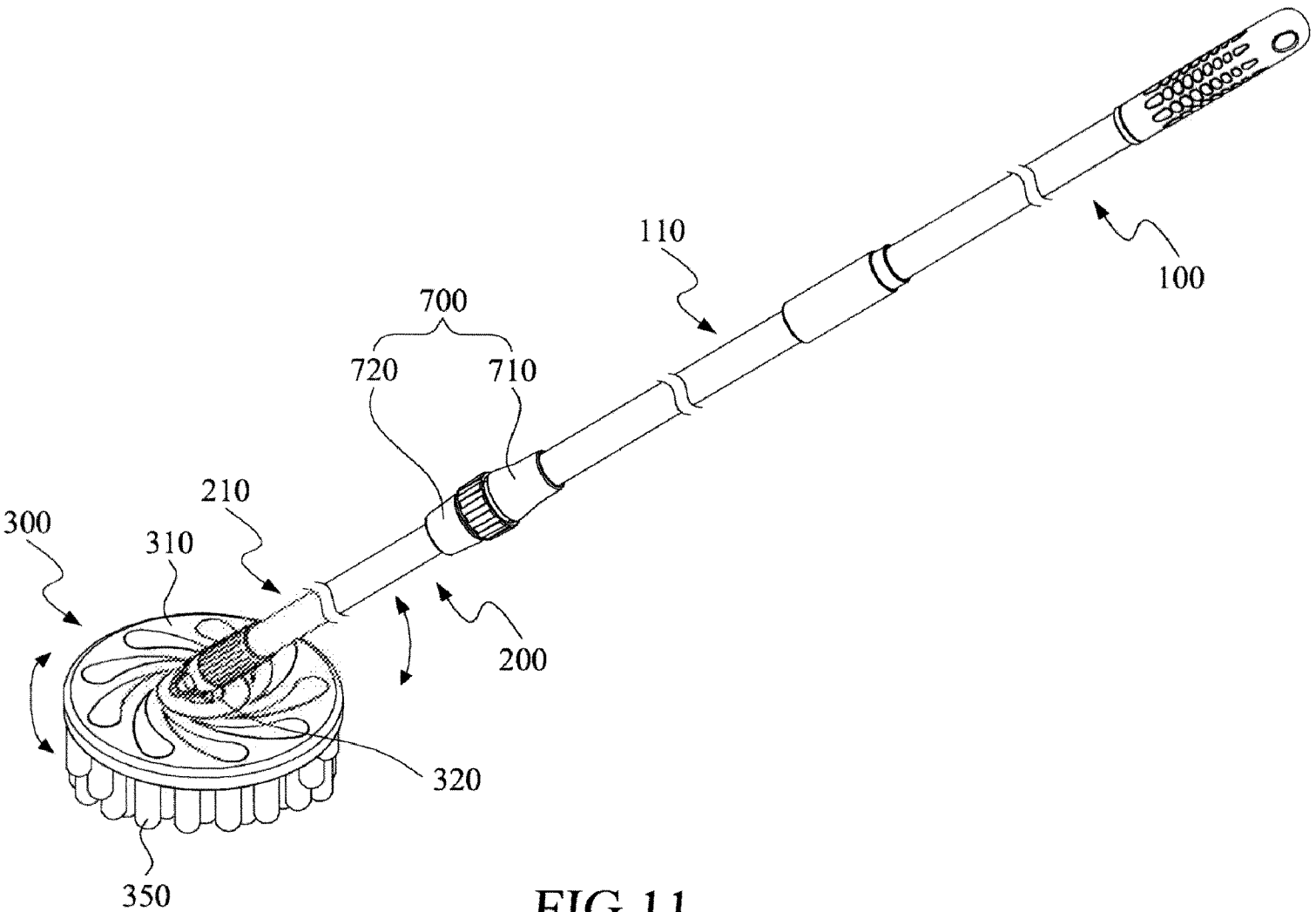
FIG. 11 illustrates the mop assembly of the present invention in use.

The circular holding plate 340 is connected detachably to a lower part of the fixing member 310. The holding plate 340 is formed with a plurality of holding holes 341 for respectively holding plurality pieces of wiping cloth 350 at several positions thereof. As illustrated in FIG. 2, several circles of pieces of wiping cloth 350 are angularly and separately disposed along the periphery of the holding plate 340 and inwardly arranged from the periphery of the holding plate 340. Each of the holding holes 341 has a restricted hole section 342 (see FIG. 12) to prevent untimely removal of the respective piece of wiping cloth 350 of the holding plate 340 after attachment in the respective holding hole 341. Referring to FIG. 11, wherein FIG. 11 illustrates the mop assembly of the present invention in use. As shown, the cleaning mop 300 of the rotary mop member 2 is rotatable relative to the rotary rod structure 200 and the handgrip structure 100 during use.

In this embodiment, the rotary rod structure 200 further includes a spring-loaded restricting member 230 disposed within the bottom end of the rotary rod 210. The spring-loaded restricting member 230 includes a rolling ball 232 placed movably in the respective positioning recess of the pivot post 321 and a coil spring 231 fixed to the rotary rod 210 and biasing the rolling ball 232, as best shown in FIG. 10, to provide resiliency so as to facilitate inclination of the assembly of the rotary rod structure 200 and the handgrip structure 100 relative to the cleaning mop 300 when the mop assembly 1 of the present invention is in use.

Figure 12:
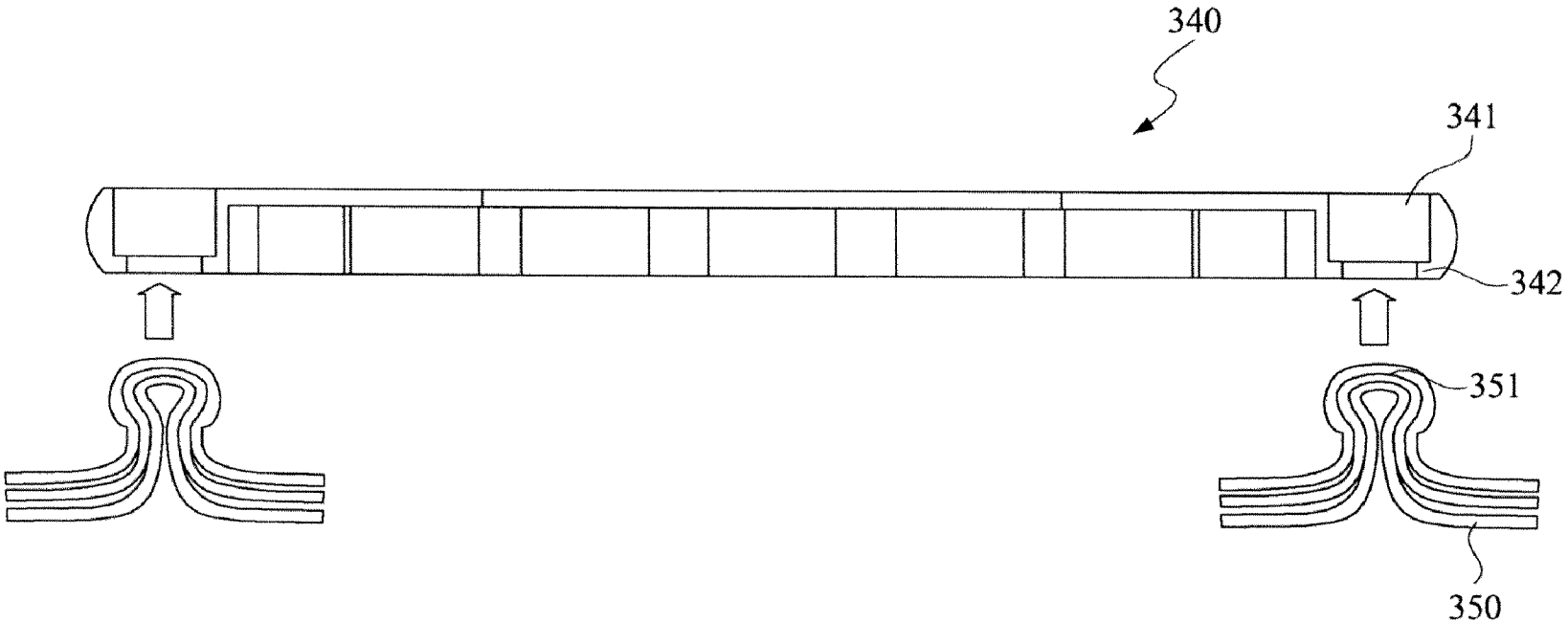
FIG. 12 illustrates how a plurality pieces of wiping cloth are inserted into a circular holding plate of the cleaning mop employed in the mop assembly of the present invention.

FIG. 12 illustrates how plurality pieces of wiping cloth 350 are inserted respectively into the holding holes 341 in the circular holding plate 340 of the cleaning mop 300 employed in the mop assembly of the present invention. For insertion each wiping cloth 350 into the respective holding hole 341, the middle section 351 of a respective wiping cloth 350 is folded so as to have a small width than the remaining portion and the folded middle section 351 is forced through the restricted hole section 342 into the holding hole 341 such that the restricted hole section 342 prevents untimely disengagement of the respective wiping cloth 350 from the holding plate 340.

Figure 13:
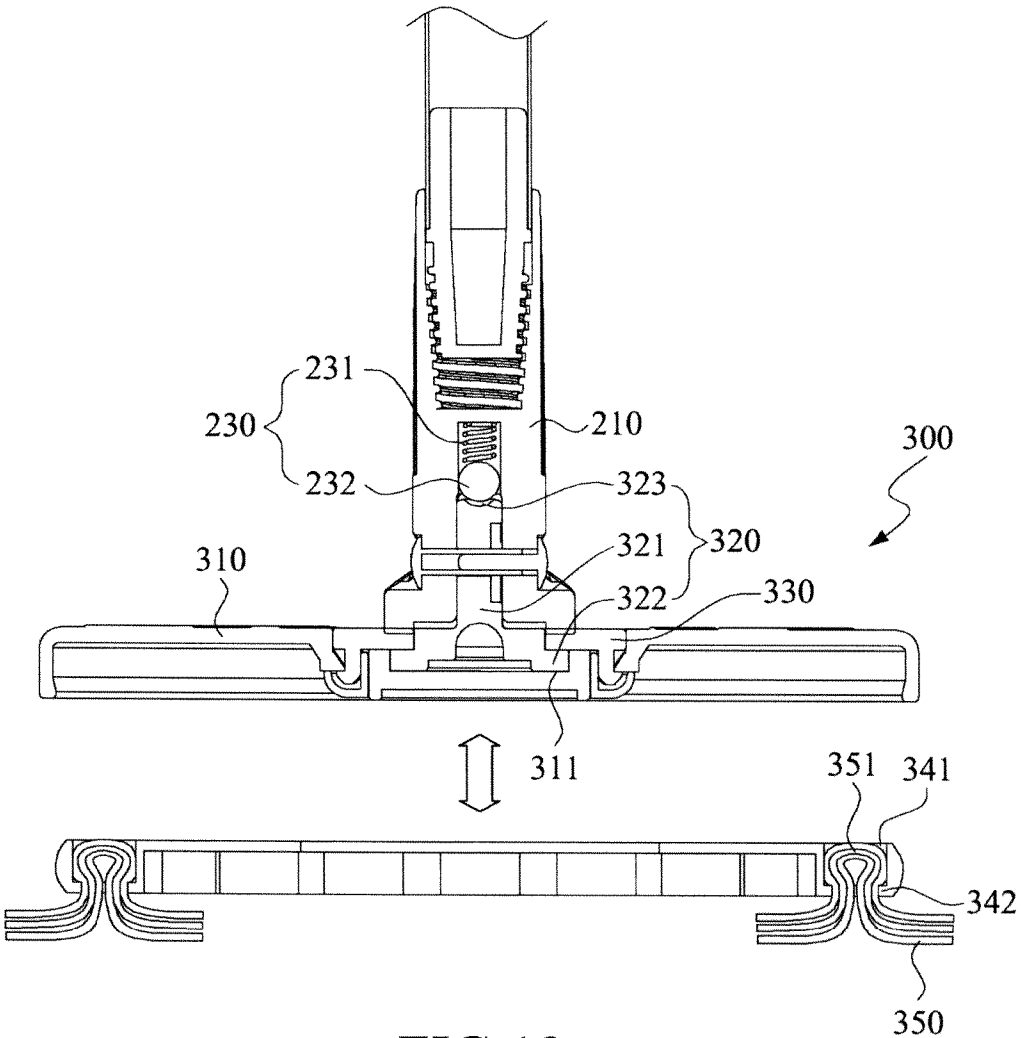
FIG. 13 illustrates how the circular holding plate shown in FIG. 12 is attached to a fixing member of the cleaning mop employed in the mop assembly of the present invention.

FIG. 13 illustrates how the circular holding plate 340 shown in FIG. 12 is attached to the fixing member 310 of the cleaning mop 300 employed in the mop assembly of the present invention. After all pieces of the wiping cloth 350 are inserted respectively into the holding holes 341 in the holding plate 340, the fixing member 310 is disposed above in alignment with the holding plate 340 and the former is forcefully pressed downward relative to the latter, thereby attaching the holding plate 340 relative to the fixing member 310. In case, the pieces of wiping cloth get dirty after a period of use, they can be cleaned by soaking water and placing the cleaning mop 300 within the draining bucket 600 as described above. When it is desired to replace the dirty pieces of wiping cloth 350 with new ones, the same can be detached manually with ease from the holding plate 340, thereby economizing a relatively expense for maintenance of the mop assembly of the present invention.

Since the mop assembly of the present invention includes simple structure, the manufacturing cost can be cut down. In the conventional mop assembly, whenever it is desired to drain the water out from the wiping cloth, the user has to manually squeeze the water out from the wiping cloth or pedal the pressing device by foot. There is also the danger for the user to fall accidentally onto the floor due to loss of stability during the pedaling operation. However, when it is desired to clean the cleaning mop of the mop assembly of the present invention, the user needs to place the cleaning mop 300 within the draining bucket 600 first and he only needs to move the handgrip structure 100 axially upward and downward relative to the rotary rod structure 200, thereby spinning the draining bucket in the predetermined direction, hence draining the water out from the cleaning mop 300.

While the invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A mop assembly comprising:

a rotary rod structure including a rotary rod defining an elongated axial space therein, and a driving unit fixed securely within said axial space of said rotary rod and formed with a central spiral hole;

a handgrip structure disposed above said rotary structure and including a handgrip rod connected telescopically to said rotary rod from above, a spiral spindle disposed within said handgrip rod, having an upper portion fixed to said handgrip rod so as to move together therewith and a lower portion engaging rotatably to said spiral hole within said driving unit and extending into said rotary rod, and a cleaning mop connected pivotally to a bottom end of said rotary rod; and a spinning structure including a water bucket, a draining bucket disposed within said water bucket for receiving said cleaning mop therein, and a support post installed vertically in said water bucket below said draining bucket in such a manner that said support post has an upper end supporting said draining bucket thereabove;

wherein, once said cleaning mop is placed within said draining bucket, axially downward movement of said handgrip structure relative to said rotary rod structure results in axial rotation of said spiral spindle within said spiral hole in said driving unit into a predetermined direction, thereby driving said draining bucket to rotate in said predetermined direction and hence draining out water from said cleaning mop by virtue of centrifugal force and wherein axially upward movement of said handgrip structure relative to said rotary rod structure results in continuously driving and rotating said draining bucket in said predetermined direction.

2. The mop assembly according to claim 1, wherein said driving unit further includes a unidirectional rotation unit in the form of a hollow tube having an outer wall fixed to an inner surface of said rotary rod, and a direction guider disposed within and rotatable relative to an inner wall of said unidirectional rotation unit in a single direction and defining said spiral hole;

wherein, axially downward movement of said handgrip structure relative to said rotary rod structure results in said axial rotation of said spiral spindle within said spiral hole, thereby driving said direction guider to rotate in said predetermined direction and hence rotating said unidirectional rotation unit and said rotary rod in said predetermined direction.

3. The mop assembly according to claim 2, wherein said unidirectional rotation unit is a unidirectional bearing unit rotatable in said single direction.

4. The mop assembly according to claim 1, wherein said driving unit further includes:

a limiting unit fixed to an inner surface of said rotary rod and defining a limiting chamber formed a lower friction face;

a direction guider disposed within said limiting chamber, defining said spiral hole and having an upper friction face; and a friction-producing element disposed within said limiting chamber between said direction guider and said lower friction face of said limiting unit, said friction-producing element having a top friction face disposed adjacent to said upper friction face of said direction guider, a bottom friction face disposed adjacent to said lower friction face of said limiting unit;

wherein, said spiral spindle extends through said limiting unit, said direction guider and said friction-producing element in such a manner that axially downward movement of said handgrip structure relative to said rotary rod structure results in said axial rotation of said spiral spindle within said spiral hole, thereby rotating said direction guider in said predetermined direction and simultaneously and axially moving said direction guider downward so as to abut said top and bottom friction faces of said friction-producing element respectively against said upper and lower friction faces of said limiting unit and said direction guider, hence generating friction force to rotate said limiting unit in said predetermined direction and that axially upward movement of said handgrip structure relative to said rotary rod structure results in axial rotation of said spiral spindle within said spiral hole, thereby rotating said direction guider in said predetermined direction and simultaneously and axially moving said direction guider upward away from said friction-producing element.

5. The mop assembly according to claim 4, wherein said friction-producing element has a truncated cone-shaped structure.

6. The mop assembly according to claim 1, wherein said cleaning mop includes:

a circular fixing member;

a pivot element for connecting pivotally said bottom end of said rotary rod to an upper part of said fixing member;

a circular holding plate connected detachably to a lower part of said fixing member; and plurality pieces of wiping cloth attached respectively to said holding plate at several positions thereof.

7. The mop assembly according to claim 1, further comprising a fastening mechanism for fastening said handgrip structure and said rotary rod structure in order to prevent axial movement and axial rotation relative to each other.

8. The mop assembly according to claim 1, wherein said water bucket includes:

a bucket body formed with a cleaning access for access to said water compartment and a circular spinning access for access to said draining bucket; and a spill-protection plate disposed between said cleaning and spinning accesses proximate to said draining bucket for preventing water spilling from said water bucket to an exterior of said water bucket via said spinning access during spinning of said draining bucket in said predetermined direction.

* * * * *

UNITED STATES PATENT AND TRADEMARK OFFICE

CERTIFICATE OF CORRECTION

PATENT NO. : 8,365,341 B2
APPLICATION NO. : 12/980896
DATED : February 5, 2013
INVENTOR(S) : Chang-I Lin It is certified that error appears in the above-identified patent and that said Letters Patent is hereby corrected as shown below:

In the Claims

Column 9, line 36, for independent claim 1, replace "." with --;-- and insert the following text immediately thereafter:

--wherein said water bucket defines a water compartment and a reception room, and includes a partition plate disposed between so as to isolate said water compartment relative to said reception room, said water bucket further including:
a support base seated securely in said reception room for receiving a lower end of said support post therein while said upper end extends through said partition plate into said water holding compartment to support said draining bucket thereabove;
wherein said lower end of said support post is received rotatably in said support base while said upper end thereof is fixed to said draining bucket, said water bucket further including a support bearing disposed between said support post and said support base to reduce friction therebetween.--

Signed and Sealed this
Eleventh Day of November, 2014

Michelle K. Lee

Michelle K. Lee
*Deputy Director of the United States Patent and Trademark Office*